US010273958B2

(12) United States Patent
Sakai

(10) Patent No.: US 10,273,958 B2
(45) Date of Patent: Apr. 30, 2019

(54) COMPRESSOR DRIVEN BY A MOTOR BASED ON A TEMPERATURE OF A DRIVE CIRCUIT

(71) Applicant: DENSO CORPORATION, Kariya, Aichi-pref. (JP)

(72) Inventor: Koji Sakai, Kariya (JP)

(73) Assignee: DENSO CORPORATION, Aichi-pref. (JP)

( * ) Notice: Subject to any disclaimer, the term of this patent is extended or adjusted under 35 U.S.C. 154(b) by 241 days.

(21) Appl. No.: 14/896,686

(22) PCT Filed: Jul. 29, 2014

(86) PCT No.: PCT/JP2014/003964
§ 371 (c)(1),
(2) Date: Dec. 8, 2015

(87) PCT Pub. No.: WO2015/025475
PCT Pub. Date: Feb. 26, 2015

(65) Prior Publication Data

US 2016/0146209 A1 May 26, 2016

(30) Foreign Application Priority Data

Aug. 22, 2013 (JP) ..... 2013-172582

(51) Int. Cl.
*F04C 29/04* (2006.01)
*F04B 35/04* (2006.01)
(Continued)

(52) U.S. Cl.
CPC ..... *F04C 29/047* (2013.01); *F04B 35/04* (2013.01); *F04B 49/02* (2013.01); *F04B 49/06* (2013.01);
(Continued)

(58) Field of Classification Search
CPC ..... F04C 29/047; F04C 29/045; F04C 28/28; F04C 28/08; F04C 18/344; F04C 29/0085;
(Continued)

(56) References Cited

U.S. PATENT DOCUMENTS

2006/0247827 A1 11/2006 Fukasaku et al.
2009/0041598 A1* 2/2009 Saito ..... F04C 18/0215 417/410.1
(Continued)

FOREIGN PATENT DOCUMENTS

EP 2 461 038 A2 6/2012

OTHER PUBLICATIONS

International Search Report and Written Opinion of the International Searching Authority dated Oct. 28, 2014 issued in the corresponding International application No. PCT/JP2014/003964 (and English translation).

*Primary Examiner* — Dominick L Plakkoottam
*Assistant Examiner* — Stephen A Mick
(74) *Attorney, Agent, or Firm* — Posz Law Group, PLC

(57) ABSTRACT

A motor-driven compressor includes: a compression mechanism; an electric motor that drives the compression mechanism; a driver circuit unit disposed at a position to be cooled by refrigerant drawn by the compression mechanism; a temperature detection unit that detects a temperature of the driver circuit unit; and a motor control device disposed in the driver circuit unit to control the motor. The motor control device stores a predetermined drive pattern corresponding to a temperature characteristic of the driver circuit unit after starting the motor. When the temperature detected by the temperature detection unit at a time of starting the motor is higher than or equal to a predetermined temperature, the motor control device performs a limit drive control accord-
(Continued)

ing to the predetermined drive pattern regardless of a drive state command to the motor.

19 Claims, 5 Drawing Sheets

(51) Int. Cl.

| | |
|---|---|
| ***F04B 49/02*** | (2006.01) |
| ***F04B 49/06*** | (2006.01) |
| ***F04C 18/344*** | (2006.01) |
| ***F04C 28/06*** | (2006.01) |
| ***F04C 28/08*** | (2006.01) |
| ***F04C 29/00*** | (2006.01) |
| ***F04C 28/28*** | (2006.01) |
| *F04C 18/02* | (2006.01) |

(52) U.S. Cl.
CPC ..... *F04C 18/344* (2013.01); *F04C 28/06* (2013.01); *F04C 28/08* (2013.01); *F04C 28/28* (2013.01); *F04C 29/0085* (2013.01); *F04C 29/045* (2013.01); *F04C 18/0215* (2013.01); *F04C 2240/808* (2013.01); *F04C 2240/81* (2013.01); *F04C 2270/19* (2013.01)

(58) Field of Classification Search
CPC ..... F04C 28/06; F04C 2240/81; F04C 2240/808; F04C 2270/19; F04C 18/0215; F04B 35/04; F04B 49/06; F04B 49/02
USPC ..... 417/32
See application file for complete search history.

(56) References Cited

U.S. PATENT DOCUMENTS

| | | | | |
|---|---|---|---|---|
| 2009/0092501 | A1* | 4/2009 | Seibel | F04B 35/04 417/44.1 |
| 2010/0178175 | A1 | 7/2010 | Koyama | |
| 2010/0232982 | A1 | 9/2010 | Nakano et al. | |
| 2011/0056226 | A1* | 3/2011 | Okubo | H02P 21/0039 62/208 |
| 2011/0120165 | A1* | 5/2011 | Byun | F04C 23/008 62/230 |
| 2012/0001575 | A1* | 1/2012 | Kubo | B60H 1/3213 318/400.17 |
| 2015/0295532 | A1 | 10/2015 | Sakai | |

* cited by examiner

COMPRESSOR DRIVEN BY A MOTOR BASED ON A TEMPERATURE OF A DRIVE CIRCUIT

CROSS REFERENCE TO RELATED APPLICATIONS

This application is the U.S. national phase of International Patent Application No. PCT/JP2014/003964 filed on Jul. 29, 2014 and is based on Japanese Patent Application No. 2013-172582 filed on Aug. 22, 2013, the disclosures of which are incorporated herein by reference.

TECHNICAL FIELD

The present disclosure relates to a motor-driven compressor in which a driver circuit unit that drives an electric motor is cooled by refrigerant drawn by a compression mechanism.

BACKGROUND ART

Up to now, there is an electric compressor in which a temperature sensor disposed in a driver circuit unit detects a temperature of a switching device. A motor is driven by reducing an output characteristic such as rotational speed or acceleration rate according to the detected temperature. Thus, the heat generation of the driver circuit unit is suppressed when the motor starts up at a high temperature. In the electric compressor, the temperature detection is repeated by the temperature sensor to sequentially update the rotational speed or the acceleration rate of the motor. With the above configuration, the rotational speed of the motor can be changed according to a change in the temperature of the switching device of the driver circuit unit, which is attributable to the heat generation caused by the switching operation or cooling by the refrigerant (for example, refer to the following Patent Literature 1).

PRIOR ART LITERATURES

Patent Literature

Patent Literature 1: JP 2009-150321 A

SUMMARY OF INVENTION

However, in the electric compressor, there is a case in which timing at which the rotational speed or the acceleration rate of the motor changes is delayed. The delay occurs due to a delay of the temperature detection by the temperature sensor with respect to the change in the temperature of the driver circuit unit which is attributable to the heat generation of the switching device or the cooling by the refrigerant. The reason why the temperature detection is delayed is because the temperature sensor detects the temperature of a heat generation component such as the switching device through a member made of an insulating material. Another reason is because the temperature sensor per se has a heat capacity.

With the above configuration, immediately after startup, when the cooling by the refrigerant is not sufficiently performed such that the temperature of the driver circuit unit is high, the detected temperature becomes lower than a real temperature of the driver circuit unit. In this case, the temperature rising suppression effect of the driver circuit unit cannot be sufficiently exerted. When the cooling by the refrigerant becomes sufficiently performed such that the temperature of the driver circuit unit is lowered, the detected temperature becomes higher than the real temperature of the driver circuit unit. In this case, the motor rotational speed is suppressed more than necessary, resulting in a reduction in the output of the compression mechanism.

The present disclosure aims at providing an electric compressor that is capable of maintaining a temperature of driver circuit unit to be lower than or equal to an allowable upper limit temperature, and that is capable of suppressing a reduction in the output of the compression mechanism.

According to an aspect of the present disclosure, a motor-driven compressor includes: a compression mechanism that draws and compresses refrigerant of a refrigeration cycle; an electric motor that drives the compression mechanism; a driver circuit unit disposed at a position to be cooled by refrigerant drawn by the compression mechanism to supply a power to the electric motor; a temperature detection unit that detects a temperature of the driver circuit unit or a relevant temperature of the temperature; and a motor control device disposed in the driver circuit unit to control a drive state of the motor based on a drive state command of the motor output by a refrigeration cycle control device that controls the refrigeration cycle.

The motor control device stores a predetermined drive pattern corresponding to a temperature characteristic of the driver circuit unit after starting the motor. When the temperature detected by the temperature detection unit at a time of starting the motor is higher than or equal to a predetermined temperature, the motor control device performs a limit drive control according to the predetermined drive pattern regardless of the drive state command. After the limit drive control is finished, the motor control device transitions to a normal drive control for driving the motor based on the drive state command.

According to the above configuration, when the temperature of the driver circuit unit or a relevant temperature is higher than or equal to a predetermined temperature at a time of starting the motor, the motor control device first controls a limit drive of the motor by a predetermined drive pattern stored in advance, not depending on a drive state command from a refrigeration cycle control device. Thereafter, the motor control device transitions from the limit drive control to a normal drive control based on the drive state command. The predetermined drive pattern is set on the basis of the heat generation characteristic of the driver circuit unit and the cooling characteristic of the driver circuit unit by the refrigerant after the motor starts, and enables the motor to be driven while limiting the supply power to the motor so that the temperature of the driver circuit unit does not exceed the allowable upper limit temperature.

As described above, when the motor starts, the motor can be driven while limiting a supply power to the motor by the predetermined drive pattern stored in advance so that the temperature of the driver circuit unit does not exceed the allowable upper limit temperature, on the basis of the temperature of the driver circuit unit or the relevant temperature which is acquired at the beginning. There is no need to repetitively acquire the temperature of the driver circuit unit or the relevant temperature, and no need to control the drive of the motor on the basis of the repetitively acquired temperature.

Therefore, when the temperature of the driver circuit unit rises, the motor can be prevented from being driven on the basis of a temperature lower than the real temperature of the driver circuit unit so as not to sufficiently suppress a temperature rise of the driver circuit unit. When the temperature of the driver circuit unit is declining, the motor can be prevented from being driven on the basis of a temperature higher than the real temperature of the driver circuit unit to suppress the drive of the motor more than necessary. In this way, when the electric compressor starts, the driver circuit unit can be maintained at the allowable upper limit temperature or lower, and the output reduction of the compression mechanism can be suppressed.

DESCRIPTION OF EMBODIMENTS

Figure 1:
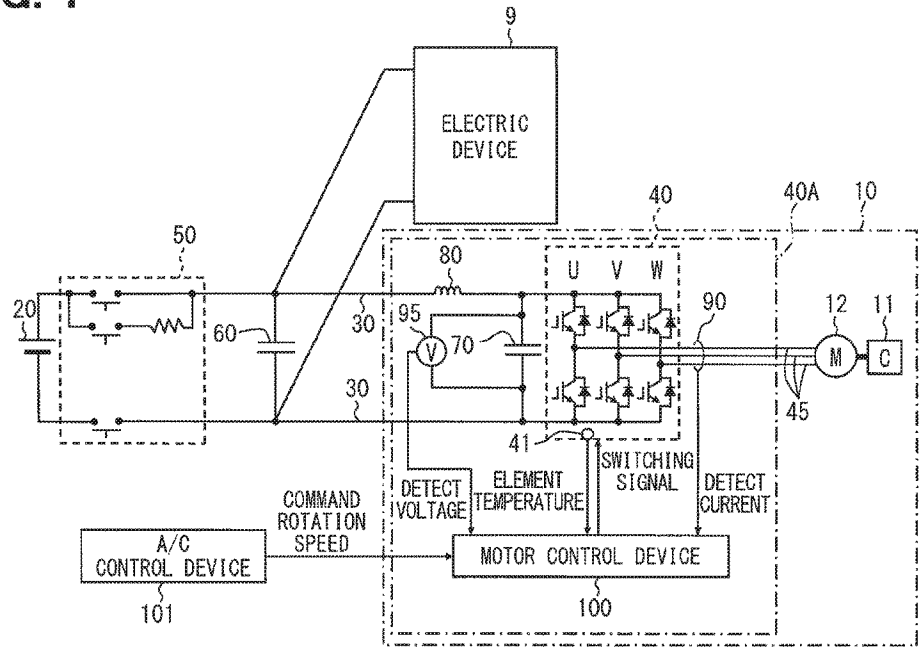
FIG. 1 is a circuit diagram illustrating a circuit including an electric compressor according to a first embodiment, partially with blocks.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment is described with reference to FIGS. 1-6.

As illustrated in FIG. 1, an electric compressor 10 according to this embodiment includes a compression mechanism 11, a synchronous motor 12, and a driver circuit unit 40A. The electric compressor 10 is a compressor arranged in a refrigeration cycle of a vehicle air conditioning apparatus with, for example, carbon dioxide as a refrigerant, and drives the compression mechanism 11 as a load by the aid of the built-in synchronous motor 12. The synchronous motor 12 corresponds to a motor according to this embodiment.

The electric compressor 10 is an electric compressor that compresses and discharges a gas-phase refrigerant in the compression mechanism 11. The compression mechanism 11 compresses the refrigerant to a critical pressure or higher, if the refrigerant is, for example, a carbon dioxide refrigerant, and discharges the refrigerant. The synchronous motor 12 according to this embodiment is, for example, a synchronous motor having a four-pole three-phase coil for rotationally driving a rotor with embedded magnets.

A DC power supply 20 that is illustrated in FIG. 1 is a DC voltage supply source having a high voltage battery capable of outputting, for example, a voltage of 288 V. A high-voltage relay system 50 is arranged in a pair of buses 30 that extend from the DC power supply 20 to an inverter circuit 40. The high-voltage relay system 50 includes a multiple relays and a resistor. The high-voltage relay system 50 has a function of switching from a path having a resistor after starting a voltage application to a path having no resistor to prevent an inrush current from flowing in the buses 30, when applying a high voltage.

The high-voltage relay system 50 blocks a power supply path in a case where an abnormal state is detected in the electric compressor 10 or the like.

As illustrated in FIG. 1, capacitors 60 and 70 as smoothing units are interposed between the pair of buses 30, which are the power supply path from the DC power supply 20 to the inverter circuit 40. The capacitor 60 is disposed to smoothen a voltage varied due to an influence of another electric device 9 that is connected to the buses 30 in parallel to the inverter circuit 40. In this example, the electric device 9 is formed of a vehicle travel motor drive device, a charging device, or a step-down DC/DC conversion device.

When, for example, multiple motor drive devices are mounted on a vehicle and the electric device 9 is the vehicle travel motor drive device, the electric device 9 is a main drive device among the motor drive devices to which power is supplied from the DC power supply 20, and the driver circuit unit 40A including the inverter circuit 40 is a minor drive device. In this example, the main drive device is a device larger in an input power fed from the DC power supply 20 than the minor drive device. The main drive device may be a device to which the power is preferentially fed when power supply to both of those drive devices is difficult.

When an input power to the electric device 9 is, for example, at least ten times larger than the input power to the electric compressor 10 via the inverter circuit 40, a variation in the voltage applied to the inverter circuit 40 from the DC power supply 20 through the buses 30 is likely to increase due to the influence of the electric device 9. The capacitor 60 is provided to suppress the voltage variation.

The capacitor 70 is provided to absorb surge and ripple caused by switching of switching device of the inverter circuit 40.

A coil 80 is disposed between a connection point between one of the buses 30 and the capacitor 60 and a connection point between the bus 30 and the capacitor 70. The coil 80 is provided to suppress an interference between the capacitors 60 and 70 that are provided in parallel between the buses 30. The coil 80 is disposed for the purpose of changing resonant frequency generated according to a relationship between the capacitor 60 and the capacitor 70. The capacitor 70 that is a capacitor element and the coil 80 that is a coil element configure a so-called LC filter circuit.

The coil 80 is a so-called normal coil. The coil 80 can be regarded as a coil component of a line connecting the capacitor 60 and the capacitor 70. A so-called common coil can be interposed between the capacitor 60 and the capacitor 70.

The inverter circuit 40 has arms of three phases of a U-phase, a V-phase, and a W-phase corresponding to stator coils of the synchronous motor 12, and converts a DC voltage input via the buses 30 into AC voltage through PWM modulation and outputs the AC voltage.

The U-phase arm is configured to have an upper arm illustrated upward in the drawing in which the switching device and a reflux diode are in anti-parallel connection and a lower arm illustrated downward in the drawing in which the switching device and a diode are in anti-parallel connection in the same manner connected in series to each other. In the U-phase arm, an output line 45 extending from a connection portion between the upper arm and the lower arm is connected to a motor coil. The V-phase arm and the W-phase arm are also similarly configured by the switching devices and diodes, and output lines 45, which extend from connection portions between upper arms and lower arms, are connected to the motor coil.

An element such as an insulated gate bipolar transistor (IGBT) can be used in the switching device. The arm that has the switching device and the diode may be a switching device such as a reverse conducting insulated gate bipolar transistor (RCIGBT) which is a power semiconductor in which the IGBT and a reverse conduction diode are integrated on one chip.

The output lines 45 are provided with a current detection device 90 for detecting a current flowing in the output lines 45 of one phase or multiple phases. A current transformer (current transformer) system, a Hall element system, or a shunt resistor system can be employed for the current detection device 90. The current detection device 90 outputs detected current information to a control device 100 to be described later.

A voltage detection device 95 for detecting a voltage between the buses 30 is provided between the pair of buses 30, for example, on a connection portion of the capacitor 70. A resistance division system can be employed for the voltage detection device 95. The voltage detection device 95 outputs the detected voltage information to the control device 100.

As a temperature detection unit that detects the temperature of the switching device, for example, a thermistor 41 is provided in the inverter circuit 40. The temperature detected by the thermistor 41 is output to the control device 100.

The control device 100 that is a control unit controls the switching operation of the respective switching devices in the inverter circuit 40 to control the driving of the synchronous motor 12. The control device 100 corresponds to a motor control device according to this embodiment. The control device 100 receives a compressor rotational speed command from an air conditioning apparatus control device 101 (hereinafter also called "A/C control device") which is a host control unit. The rotational speed command is an example of a motor drive state command. The control device 100 receives motor coil current information detected by the current detection device 90 and voltage information detected by the voltage detection device 95. The control device 100 calculates a rotational position of the motor on the basis of those input information without a position sensor.

The control device 100 receives switching device temperature information detected by the thermistor 41. The control device 100 determines a voltage command for controlling the synchronous motor 12 on the basis of the input information or the calculation information described above, generates a PWM wave that is a switching signal, and outputs the PWM wave to the inverter circuit 40.

As is apparent from FIG. 1, a configuration including the inverter circuit 40, the capacitor 70, the coil 80, and the control device 100 is a driver circuit unit 40A that supplies a power to the synchronous motor 12 for driving the synchronous motor 12 in this embodiment.

The A/C control device 101 is a control unit that controls the driving of multiple actuator mechanisms of the vehicle air conditioning apparatus on the basis of various setting conditions, various environmental conditions, and the like. The electric compressor 10 is arranged in, for example, an engine room of an automobile. The electric compressor 10 is disposed adjacent to a heat generating equipment such as an engine. The electric compressor 10 includes the refrigeration cycle device for the vehicle air conditioning apparatus together with a heat radiator, a decompressor, and an evaporator. The A/C control device 101 corresponds to a refrigeration cycle control device according to this embodiment.

Figure 2:
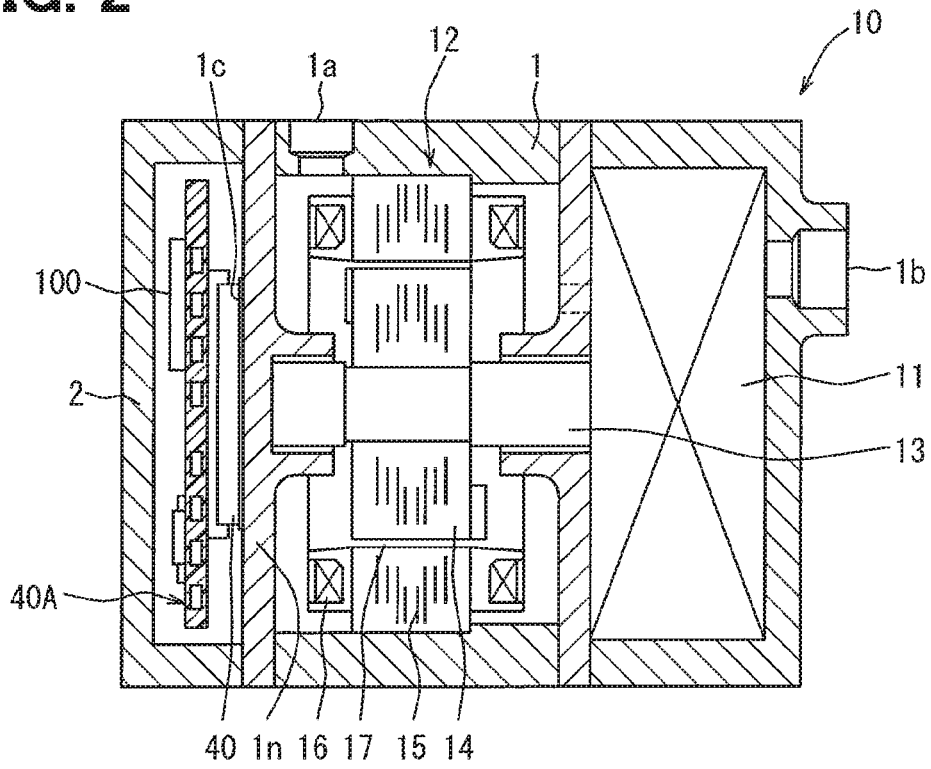
FIG. 2 is a schematic cross-sectional view illustrating the electric compressor according to the first embodiment.

As illustrated in FIG. 2, the electric compressor 10 is provided with a housing 1. The housing 1 is made of a metal with high thermal conductivity, such as an aluminum material and an aluminum alloy material, and is formed into a substantially cylindrical shape. A refrigerant intake port 1*a* and a refrigerant discharge port 1*b* are provided in the housing 1.

The refrigerant intake port 1*a* is arranged on one side of the housing 1 in an axial direction which is a left side in the drawing. The refrigerant intake port 1*a* is defined to penetrate through a cylindrical portion of the housing 1 in a radial direction. A refrigerant from a refrigerant outlet of the evaporator flows into the refrigerant intake port 1*a*. The refrigerant discharge port 1*b* is arranged on the other side of the housing 1 in the axial direction. The refrigerant discharge port 1*b* discharges the refrigerant toward a refrigerant inlet of the heat radiator.

The electric compressor 10 includes the compression mechanism 11, the synchronous motor 12, the driver circuit unit 40A, an inverter cover 2, and the like. The synchronous motor 12 includes a rotating shaft 13, a rotor 14, a stator core 15, a stator coil 16 that is a motor coil, and the like.

The rotating shaft 13 is arranged in the housing 1. An axial direction of the rotating shaft 13 matches with an axial direction of the housing 1. The rotating shaft 13 is supported to be rotatable by two bearings. The rotating shaft 13 transmits a rotational driving force received from the rotor 14 to the compression mechanism 11. The bearings are supported by the housing 1.

The rotor 14 is, for example, embedded with a permanent magnet, formed into a tubular shape, and fixed to the rotating shaft 13. The rotor 14 rotates with the rotating shaft 13 on the basis of a rotating magnetic field that is generated from the stator core 15.

The stator core 15 is disposed on a radially outer circumferential side with respect to the rotor 14 in the housing 1. An axial direction of the stator core 15, which is formed into a tubular shape, matches with the axial direction of the rotating shaft 13. A gap is defined between the stator core 15 and the rotor 14. The gap defines a refrigerant flow channel 17 in which the refrigerant flows in the axial direction of the rotating shaft 13.

The stator core 15 is formed of a magnetic body, and is supported on an inner circumferential surface of the housing 1. The stator coil 16 is wound around the stator core 15. The stator coil 16 generates a rotating magnetic field.

The compression mechanism 11 is disposed on the other side of the synchronous motor 12 in the axial direction which is a right side in the drawing. The compression mechanism 11 is, for example, a scroll compressor including a fixed scroll and a movable scroll. The compression mechanism 11 pivots the movable scroll by the aid of a rotational driving force from the rotating shaft 13 of the synchronous motor 12 and draws, compresses, and discharges the refrigerant. The compression mechanism 11 is not limited to the scroll type, but may be of a rotary type having a vane.

The driver circuit unit 40A is mounted on a mounting surface 1*c* of the housing 1. The inverter circuit 40 of the driver circuit unit 40A is disposed in such a manner that a package unit having multiple switching devices comes into press contact with the mounting surface 1*c* through an electric insulating radiation sheet. The mounting surface 1*c* is formed on an outer surface of a wall part 1*n* (end wall part on a left side in the figure) on an opposite side of the compression mechanism in the axial direction of the housing 1.

The driver circuit unit 40A includes the driver circuit that generates three-phase voltage for driving the synchronous motor 12. The inverter cover 2 is made of, for example, metal or resin, and formed to cover the driver circuit unit 40A. The inverter cover 2 is fastened with a screw (not illustrated) to the housing 1.

When a three-phase driving electric current flows in the stator coil 16 of the synchronous motor 12 illustrated in FIG. 2, the rotating magnetic field is generated from the stator core 15, and thus a rotational force is generated on the rotor 14. Then, the rotor 14 rotates together with the rotating shaft 13. The rotational driving force from the rotating shaft 13 causes the compression mechanism 11 to pivot and draw the refrigerant.

In this case, the low-temperature and low-pressure intake refrigerant from the evaporator side flows into the housing 1 from the refrigerant intake port 1*a*. Then, the intake refrigerant flows along the wall part 10, and thereafter passes through the refrigerant flow channel 17, and flows toward the compression mechanism 11. The refrigerant flowing in the housing 1 flows to pivot around the axis due to the rotation of the rotor 14. The intake refrigerant is compressed by the compression mechanism 11, and discharged from the refrigerant discharge port 1*b* toward the heat radiator. The electric compressor 10 increases the amount of refrigerant drawn, compressed, and discharged by the compression mechanism 11 more as the rotational speed of the synchronous motor 12 increases more.

On the other hand, the driver circuit unit 40A generates heat when the driver circuit unit 40A is in operation. In particular, the inverter circuit 40 generates a large amount of heat with the operation of the inverter circuit 40. The heat generated by the driver circuit unit 40A is transferred to the intake refrigerant flowing along the wall part 1*n* through the wall part 1*n* of the housing 1. With the above configuration, the intake refrigerant drawn by the compression mechanism 11 enables the driver circuit unit 40A to be cooled.

In this situation, the stator coil 16 generates a heat with the supply of the three-phase driving current. The heat generated from the stator coil 16 is transferred through the stator core 15 to the intake refrigerant in the refrigerant flow channel 17. With the above configuration, the stator core 15 and the stator coil 16 can be cooled by the intake refrigerant. In order to cool the stator core 15 and the stator coil 16, a refrigerant flow channel may be defined in a part between the housing 1 and the stator core 15.

When the electric compressor 10 starts the operation from a stop state, the heat generation of the driver circuit unit 40A starts from immediately after startup. When the electric compressor 10 starts the operation from the stop state, the intake refrigerant starts to flow within the housing 1. However, the intake refrigerant immediately after starting to flow is a refrigerant stagnant on a downstream side of the decompressor in the refrigerant flow. The intake refrigerant is maintained at substantially the same temperature as an outside air temperature of the evaporator or a refrigerant piping that connects the evaporator and the housing 1, which is relatively high in temperature. The amount of heat generated by the driver circuit unit 40A is conducted to the intake refrigerant through, for example, a package of the switching devices, an electric insulating radiation sheet, the wall part 1*n*, and the like. In other words, the cold of the intake refrigerant is conducted to the driver circuit unit 40A through the wall part 1*n* and the like. Therefore, the temperature of the driver circuit unit 40A rises immediately after the electric compressor 10 starts.

When the electric compressor 10 continues the operation, the temperature of the intake refrigerant flowing in the housing 1 decreases, the cold of the intake refrigerant also reaches the driver circuit unit 40A, and the driver circuit unit 40A is cooled. As a result, the driver circuit unit 40A stops the temperature rise and decreases the temperature some time after the electric compressor 10 starts, and thereafter the temperature of the driver circuit unit 40A converges on a temperature of the steady state.

Figure 3:
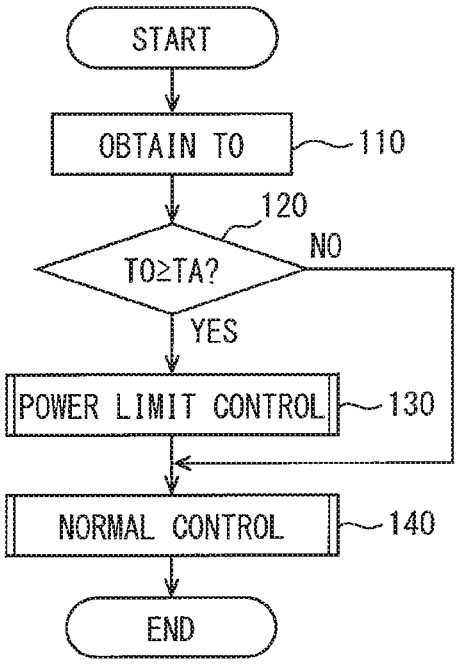
FIG. 3 is a flowchart illustrating schematic control operation when a motor control device starts a motor according to the first embodiment.

Subsequently, the driving control operation of the control device 100 when starting the electric compressor 10 will be described with reference to FIGS. 3 and 4. When starting the electric compressor 10, the control device 100 first acquires an initial temperature T0 of the switching device which is a heat generation component on the basis of the temperature information input from the thermistor 41 (Step 110). Then, the control device 100 determines whether the initial temperature T0 acquired in Step 110 is higher than or equal to a determination temperature TA, or not (Step 120). The execution of Steps 110 and 120 is performed, for example, only once when the electric compressor 10 starts.

In Step 120, if it is determined that the initial temperature T0 is higher than or equal to or the determination temperature TA, the control device 100 starts and drives the synchronous motor 12 under a power limit control for limiting the supply power to the synchronous motor 12 to drive the synchronous motor 12 (S130). Then, after Step 130 has been executed, the control device 100 transitions to the normal drive control (Step 140). If it is determined in Step 120 that the initial temperature T0 is lower than the determination temperature TA, the control device 100 jumps Step 130, and proceeds to Step 140, and starts and drives the synchronous motor 12 under the normal drive control without performing the power limit control. Hereinafter, the power limit control may be called "limit drive control", and the normal drive control may be called "normal control".

The determination temperature TA used in Step 120 is a threshold temperature for determining whether the temperature of the driver circuit unit 40A reaches the allowable upper limit temperature, or not, if the synchronous motor 12 is not driven by the predetermined drive pattern. The determination temperature TA is set according to whether the temperature of the driver circuit unit 40A reaches the allowable upper limit temperature, or not, for example, when the synchronous motor 12 is driven under the normal drive control since startup. The normal drive control is a control for driving the synchronous motor 12 so that the rotational speed of the synchronous motor 12 matches a rotational speed command value (target rotational speed), on the basis of a compressor rotational speed command from the A/C control device 101 which is a host control device of the control device 100.

The determination temperature TA is a temperature to be compared with the initial temperature T0 of the switching device, which is detected by the thermistor 41 in this example, but is not limited to this example. The heat generation component of the driver circuit unit 40A includes, for example, the switching devices of the inverter circuit 40, the capacitor 70, the coil 80, and so on. It is preferable that among those heat generation components, the heat generation components that are relatively large in the amount of heat generation, and cause the temperatures of the heat generation components per se, or other components of the driver circuit unit 40A to be likely to increase up to the allowable upper limit temperature at the time of heat generation are detection targets of the initial temperature T0. In association with this configuration, it is preferable that the determination temperature TA is also set to a value corresponding to the detection target of the initial temperature T0.

The power limit control described above is a control for driving the synchronous motor 12 in a predetermined drive pattern for limiting the rotational speed of the synchronous motor 12 so that the temperature of the driver circuit unit 40A does not exceed the allowable upper limit temperature. The power limit control is a rotational speed limit drive control in this example. The predetermined drive pattern is set on the basis of the temperature characteristic of the driver circuit unit 40A. Specifically, the predetermined drive pattern is set on the basis of, for example, the heat generation characteristic and the cooled characteristic of the driver circuit unit 40A, and the cooling characteristic of the driver circuit unit 40A caused by the intake refrigerant.

The predetermined drive pattern can be set, for example, as follows. A change in the temperature of the driver circuit unit 40A after the synchronous motor 12 starts in multiple states different in target rotational speed of the synchronous motor 12 is measured. The predetermined drive pattern in which the temperature of the driver circuit unit 40A extremely approximates the allowable upper limit temperature, and which limits to the rotational speed that does not exceed the allowable upper limit temperature is selected from the multiple measurement results and set. Alternatively, the predetermined drive pattern is set from the multiple measurement results with an estimated interpolation. The predetermined drive pattern set in this way is stored in a storage unit of the control device 100 in advance.

The predetermined drive pattern stored in the control device 100 is one drive pattern in this example. In this case, the predetermined drive pattern is set taking into consideration that the electric compressor 10 starts in a range of from the determination temperature TA to a highest expected temperature under a vehicle environment. The predetermined drive pattern is set also taking a variation in the heat generation characteristic of the heat generation component into account. In order to reduce variation factors of the heat generation characteristic of the heat generation component, it is preferable that the predetermined drive pattern satisfies, for example, an operation condition that can most suppress the temperature rise of the heat generation component.

Figure 4:
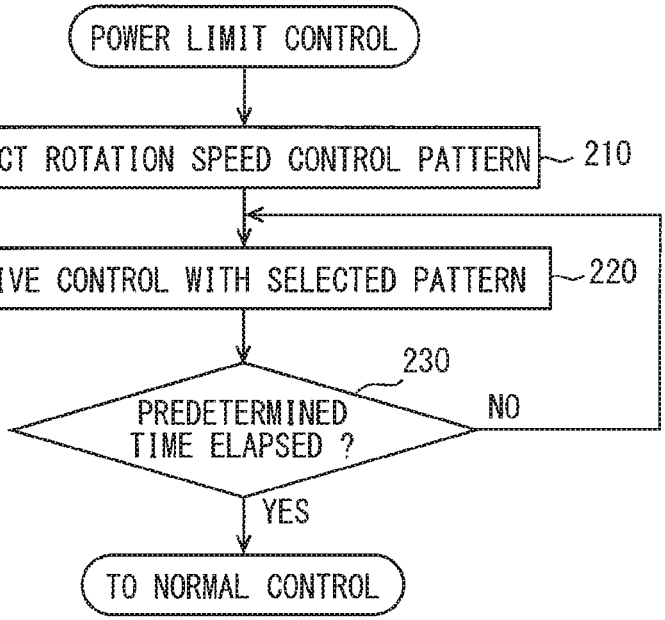
FIG. 4 is a flowchart illustrating power limit control operation of the motor control device according to the first embodiment.

When the control device 100 executes the power limit control in Step 130, as illustrated in FIG. 4, the control device 100 first selects a rotational speed control pattern which is the predetermined drive pattern stored (Step 210). Then, the control device 100 outputs a switching signal for driving the synchronous motor 12 to the inverter circuit 40 according to the selected rotational speed control pattern (Step 220). When performing the drive control of the synchronous motor 12 in Step 220, the control device 100 performs the drive control by the rotational speed control pattern selected in Step 210 without the use of the rotational speed command input from the A/C control device 101.

The control device 100 monitors whether a predetermined time has elapsed, or not, while executing Step 220 (Step 230). The predetermined time in Step 230 is a required time in the rotational speed control pattern selected in Step 210. If it is determined that the predetermined time does not elapse in Step 230, that is, if it is determined that the operation using the rotational speed control pattern is not finished, the control device 100 returns to Step 220. If it is determined that the predetermined time has elapsed in Step 230, the control device 100 finishes the power limit control using the rotational speed control pattern, and transitions to the normal control in Step 140 of FIG. 3.

According to the configurations and the operation described above, the control device 100 stores in advance the predetermined drive pattern when starting the synchronous motor 12, which is set on the basis of the heat generation characteristic of the driver circuit unit 40A after the synchronous motor 12 starts, and the cooling characteristic of the driver circuit unit 40A caused by the intake refrigerant. The predetermined drive pattern is a drive pattern capable of driving the synchronous motor 12 while limiting the rotational speed of the synchronous motor 12 so that the temperature of the driver circuit unit 40A does not exceed the allowable upper limit temperature.

Because the rotational speed of the synchronous motor 12 bears a substantially proportionate relationship to the power to be supplied to the synchronous motor 12, the predetermined drive pattern is a drive pattern capable of driving the synchronous motor 12 while limiting the supply power to the synchronous motor 12 so that the temperature of the driver circuit unit 40A does not exceed the allowable upper limit temperature.

If the temperature detected by the thermistor 41 at the time of starting the synchronous motor 12 is equal to or higher than the determination temperature TA, the control device 100 controls the rotational speed limit drive of the synchronous motor 12 in the predetermined drive pattern regardless of the rotational speed command from the host control device. Then, after the rotational speed limit drive control in the predetermined drive pattern has been finished, the control device 100 transitions to the normal drive control for driving the synchronous motor 12 on the basis of the rotational speed command.

According to the above configuration, in the case where the temperature of the driver circuit unit 40A is equal to or higher than the predetermined temperature when the synchronous motor 12 starts, the control device 100 first controls the limit drive of the synchronous motor 12 by the predetermined drive pattern stored in advance, not depending on a rotational speed command from the A/C control device 101. Thereafter, the control device 100 transitions from the limit drive control to a normal drive control based on the rotational speed command. The predetermined drive pattern is set on the basis of the heat generation characteristic of the driver circuit unit 40A after the synchronous motor 12 starts, and the cooling characteristic of the driver circuit unit 40A caused by the intake refrigerant. The predetermined drive pattern is a drive pattern capable of driving the motor while limiting the supply power to the synchronous motor 12 so that the temperature of the driver circuit unit 40A does not exceed the allowable upper limit temperature.

As described above, when the synchronous motor 12 starts, the control device 100 can drive the motor while limiting the power supply to the motor by the predetermined drive pattern stored in advance so that the temperature of the driver circuit unit 40A does not exceed the allowable upper limit temperature, on the basis of the temperature of the driver circuit unit 40A acquired at the beginning. There is no need to repetitively acquire the temperature of the driver circuit unit 40A, and control the drive of the synchronous motor 12 on the basis of the repetitively acquired temperature.

Therefore, when the temperature of the driver circuit unit 40A rises, the synchronous motor 12 can be prevented from being driven on the basis of a temperature lower than the real temperature of the driver circuit unit 40A so as not to sufficiently suppress a temperature rise of the driver circuit unit 40A. When the temperature of the driver circuit unit 40A is reduced, the synchronous motor 12 can be prevented from being driven on the basis of a temperature higher than the real temperature of the driver circuit unit 40A to suppress the drive of the synchronous motor 12 more than necessary. In this way, when the electric compressor 10 starts, the driver circuit unit 40A can be surely maintained at the allowable upper limit temperature or lower, and the output reduction of the compression mechanism 11 can be suppressed.

With the suppression of the output reduction of the compression mechanism 11, the output reduction of the vehicle air conditioning apparatus which is a host system can be suppressed.

Figure 5:
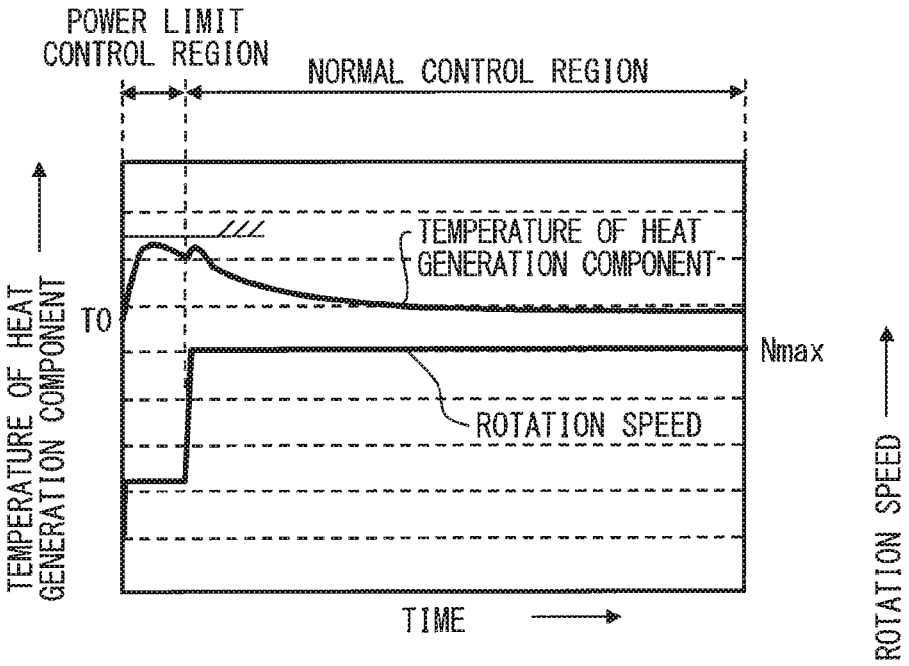
FIG. 5 is a time chart illustrating a relationship between a temperature of a heat generation component and a rotational speed of a synchronous motor according to the first embodiment.

As illustrated in FIG. 5, if the initial temperature T0 detected by the thermistor 41 is higher than the determination temperature TA, the synchronous motor 12 is driven at the predetermined rotational speed set and stored in advance, in a power limit control region until the predetermined time elapses immediately after startup. The amount of heat generation of the heat generation component in the driver circuit unit 40A is suppressed by the drive pattern for limiting the power for driving the synchronous motor 12 at the predetermined rotational speed regardless of the target rotational speed, and the heat generation component temperature does not exceed the allowable upper limit temperature. After the power limit control using the predetermined drive pattern has been finished, the normal control for driving the synchronous motor 12 at the target rotational speed is performed.

Figure 6:
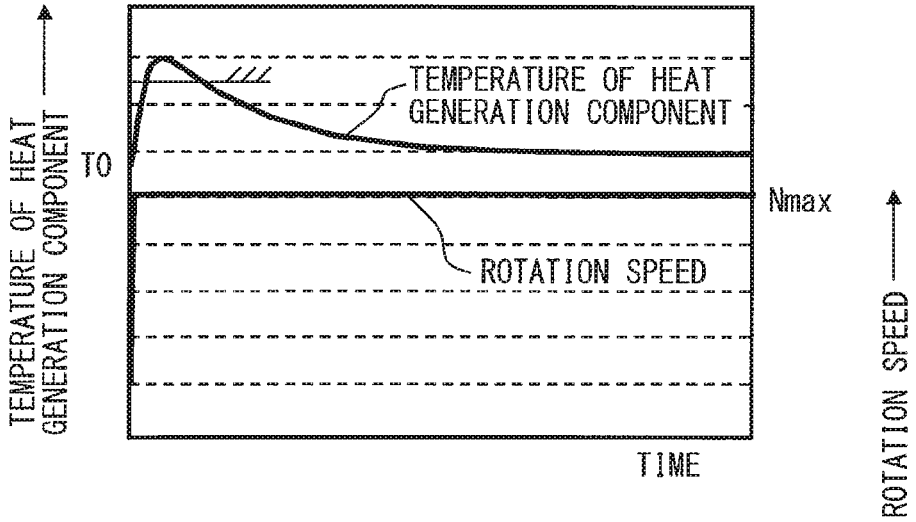
FIG. 6 is a time chart illustrating a relationship between a temperature of a heat generation component and a rotational speed of a synchronous motor in a comparative example.

In a comparative example illustrated in FIG. 6, the normal control for driving the synchronous motor 12 at the target rotational speed is performed from immediately after startup. This may lead to a case in which the amount of heat generation of the heat generation component is not suppressed, and the temperature of heat generation component exceeds the allowable upper limit temperature.

As is apparent from FIG. 5, when transitioning from the power limit control to the normal control, because the power to be supplied to the synchronous motor 12 increases, the temperature of the heat generation component in the driver circuit unit 40A may again rise immediately after transition.

The predetermined drive pattern stored in advance by the control device 100 of this embodiment is set so that the temperature of the driver circuit unit 40A does not exceed the allowable upper limit temperature on the basis of an increase in the amount of heat generation of the driver circuit unit 40A caused by an increase in the supply power when transitioning from the limit drive control to the normal drive control.

According to the above configuration, the control device 100 stores in advance the predetermined drive pattern set so that the temperature of the driver circuit unit 40A does not exceed the allowable upper limit temperature on the basis of an increase in the amount of heat generation of the driver circuit unit 40A caused by an increase in the motor supply power when transitioning from the limit drive control to the normal drive control. Therefore, even when transitioning from the limit drive control by the predetermined drive pattern to the normal drive control, the temperature of the driver circuit unit 40A can be prevented from exceeding the allowable upper limit temperature. In this way, when the electric compressor 10 starts, the driver circuit unit 40A can be surely maintained at the allowable upper limit temperature or lower.

The electric compressor 10 is mounted in the vehicle. The environment of the electric compressor 10 mounted in the vehicle is likely to be relatively high in temperature due to, for example, the arrangement of the electric compressor 10 in the vicinity of another heat generation equipment such as an engine. Therefore, in the electric compressor 10 mounted in the vehicle, according to the present disclosure, the advantages that the driver circuit unit 40A can be surely maintained at the allowable upper limit temperature or lower when the electric compressor 10 starts, and the output reduction of the compression mechanism 11 can be suppressed are extremely large.

The predetermined drive pattern stored in the control device 100 according to this embodiment is one drive pattern, but is not limited to this configuration. The predetermined drive pattern may be multiple predetermined drive patterns corresponding to the multiple temperature range equal to or higher than the determination temperature TA. In that case, the control device 100 extracts a predetermined drive pattern corresponding to the initial temperature T0 from the stored multiple predetermined drive patterns according to which temperature the initial temperature T0 at the time of startup corresponds in the multiple temperature range. As a result, the control pattern different in the motor rotational speed or a power limit control time is extracted according to the initial temperature T0, and the power limit control of the rotation as high as possible can be performed in a range where the temperature of the driver circuit unit 40A does not exceed the allowable upper limit temperature.

In this embodiment, the power limit control performed by the control device 100 is performed by a control for limiting the motor rotational speed, but not limited to this control. For example, the power limit control may be performed by a control for limiting at least one of an input power and an output power having substantially a proportional relationship to the rotational speed.

The drive state command of the synchronous motor 12 input from the A/C control device 101 that is the host control device used when the control device 100 performs the normal control is not limited to the rotational speed command. For example, the supply power information may be input as the drive state command. The information related to the supply power is not limited to that input from the A/C control device 101, but may be input directly from the vehicle control device for controlling power feeding within the vehicle, which is, for example, the host control device of the A/C control device 101. The control device 100 can receive the drive state command of the synchronous motor 12 from the refrigeration cycle control device for controlling the refrigeration cycle including the electric compressor 10 directly or indirectly.

In this embodiment, the predetermined drive pattern is formed by the motor rotational speed and a time during which the operation is continued at that rotational speed, but the time may not be used. For example, the predetermined drive pattern may be configured by a pattern using a rotation angle of the motor or the rotational position.

Second Embodiment

A second embodiment will be described with reference to FIGS. 7 to 9.

A second embodiment is different from the first embodiment described above in that a power limit control is divided into multiple periods. The same portions as those in the first embodiment are denoted by identical reference numerals, and their description will be omitted. Components denoted by the same symbols as those in the drawings according to the first embodiment and the other configurations not described in the second embodiment are identical with those in the first embodiment, and the same advantages are obtained.

Figure 7:
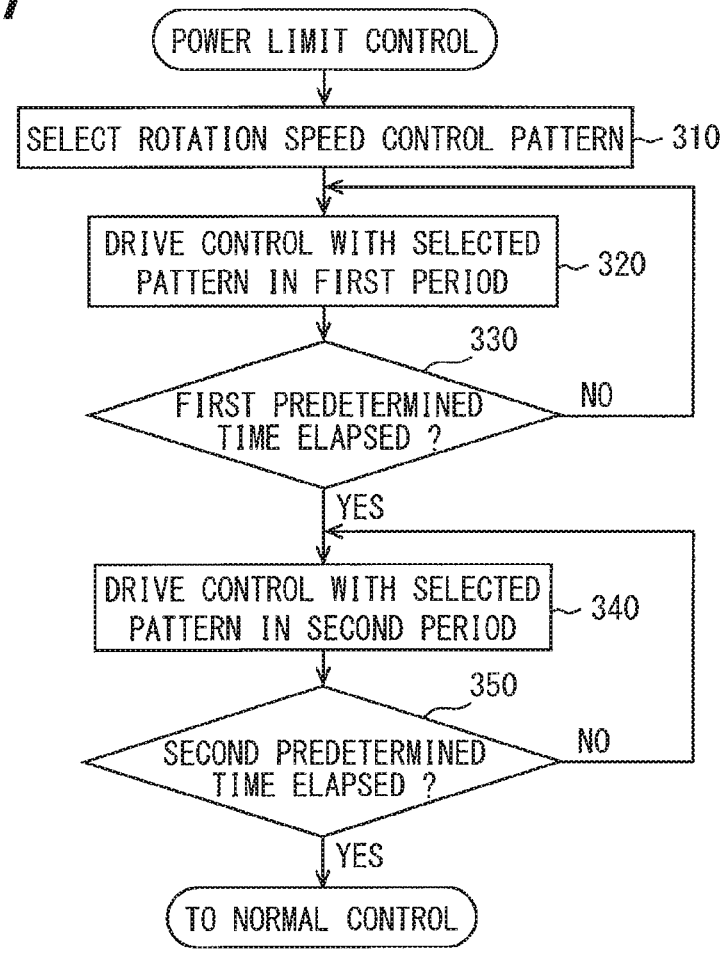
FIG. 7 is a flowchart illustrating power limit control operation of a motor control device according to a second embodiment.

In this embodiment, when the control device 100 executes the power limit control, as illustrated in FIG. 7, the control device 100 first extracts a rotational speed control pattern which is the predetermined drive pattern stored (Step 310). A rotational speed control pattern according to this embodiment has a first period and a second period transitioning from the first period. The rotational speed in the second period is larger than the rotational speed in the first period.

After Step 310 has been executed, the control device 100 outputs a switching signal for driving the synchronous motor 12 to the inverter circuit 40 according to the first period of the extracted rotational speed control pattern (Step 320). When performing the drive control of the synchronous motor 12 in Step 320, the control device 100 performs the drive control by the rotational speed information in the first period of the rotational speed control pattern extracted in Step 310 without the use of the rotational speed command input from the A/C control device 101.

The control device 100 monitors whether a first predetermined time has elapsed, or not, while executing Step 320 (Step 330). The first predetermined time in Step 330 is a required time of the first period in the rotational speed control pattern extracted in Step 310. If it is determined that the first predetermined time does not elapse in Step 330, that is, if it is determined that the operation of the rotational speed control pattern in the first period is not finished, the control device 100 returns to Step 320. If it is determined that the first predetermined time has elapsed in Step 330, the control device proceeds to Step 340.

In Step 340, the control device 100 outputs a switching signal for driving the synchronous motor 12 to the inverter circuit 40 according to the second period of the extracted rotational speed control pattern. When performing the drive control of the synchronous motor 12 in Step 340, the control device 100 performs the control by the rotational speed information of the second period in the rotational speed control pattern extracted in Step 310 without the use of the rotational speed command input from the A/C control device 101.

The control device 100 monitors whether a second predetermined time has elapsed, or not, while executing Step 340 (Step 350). The second predetermined time in Step 350 is a required time of the second period in the rotational speed control pattern extracted in Step 310. If it is determined that the second predetermined time does not elapse in Step 350, that is, if it is determined that the operation of the rotational speed control pattern in the second period is not finished, the control device 100 returns to Step 340. If it is determined that the second predetermined time has elapsed in Step 350, the control device 100 finishes the power limit control using the rotational speed control pattern, and transitions to the normal control.

According to this embodiment, when starting the electric compressor 10, the control device 100 can rapidly increase the motor rotational speed more than that in the first embodiment while surely maintaining the driver circuit unit 40A at the allowable upper limit temperature or lower. Therefore, the control device 100 can further suppress the output reduction of the compression mechanism 11.

Figure 8:
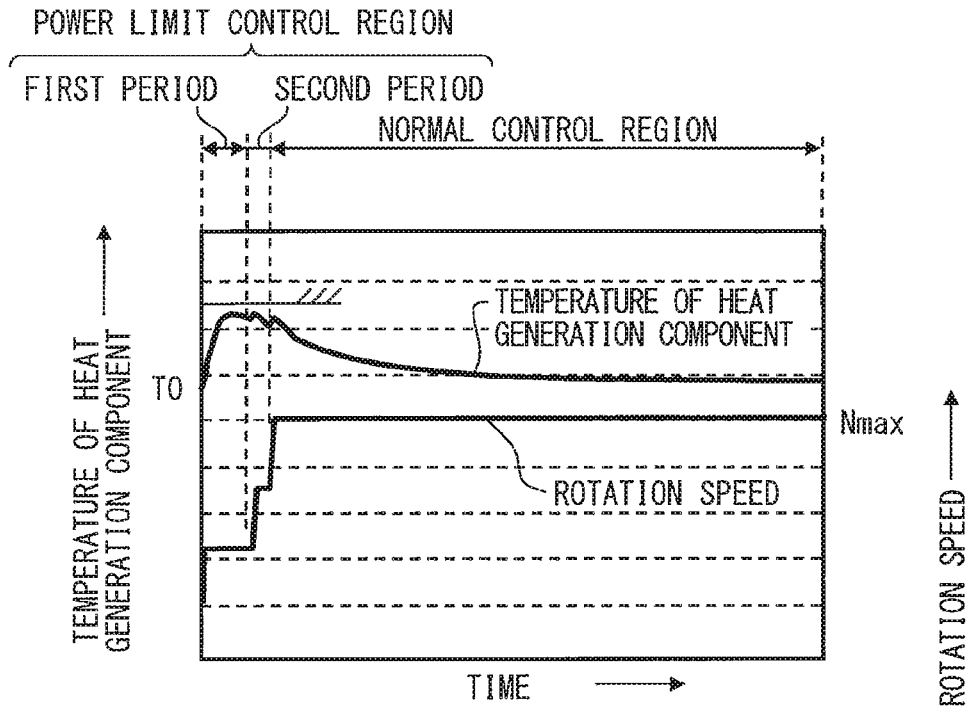
FIG. 8 is a time chart illustrating a relationship between a temperature of a heat generation component and a rotational speed of a synchronous motor according to the second embodiment.
Figure 9:
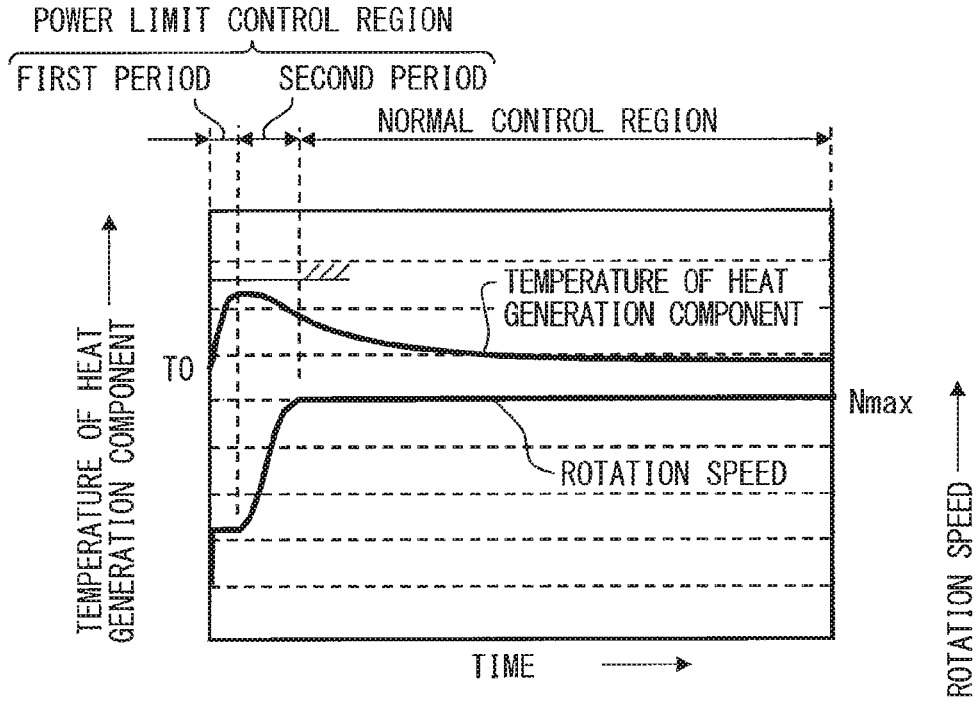
FIG. 9 is a time chart illustrating a relationship between a temperature of a heat generation component and a rotational speed of a synchronous motor according to a modification of the second embodiment.

As illustrated in FIG. 8, if the initial temperature T0 detected by the thermistor 41 is higher than the determination temperature TA, the synchronous motor 12 is driven at the first predetermined rotational speed set and stored in advance, in a first period region of the power limit control until the first predetermined time elapses immediately after startup. After the first predetermined time has elapsed, the synchronous motor 12 is driven at the second predetermined rotational speed set and stored in advance in a second period region of the power limit control until the second predetermined time further elapses. The second predetermined rotational speed is set to be larger than the first predetermined rotational speed.

The amount of heat generation of the heat generation component in the driver circuit unit 40A is suppressed by the drive pattern for limiting the power for sequentially driving the synchronous motor 12 at the first predetermined rotational speed and the second predetermined rotational speed regardless of the target rotational speed, and the heat generation component temperature does not exceed the allowable upper limit temperature. After the power limit control using the predetermined drive pattern has been finished, the normal control for driving the synchronous motor 12 at the target rotational speed is performed.

As is apparent from FIG. 8, not only when transitioning from the power limit control to the normal control, but also when transitioning from the first period of the power limit control to the second period, the power to be supplied to the synchronous motor 12 increases. For that reason, the temperature of the heat generation component of the driver circuit unit 40A may rise even immediately after transition.

The predetermined drive pattern stored by the control device 100 of this embodiment in advance has the first period and the second period transitioning from the first period, and the supply power in the second period is larger than the supply power in the first period. The temperature of the driver circuit unit 40A is set not to exceed the allowable upper limit temperature on the basis of an increase in the amount of heat generation of the driver circuit unit 40A caused by an increase in the supply power when transitioning from the first period to the second period.

According to the above configuration, the control device 100 stores in advance the predetermined drive pattern set so that the temperature of the driver circuit unit 40A does not exceed the allowable upper limit temperature on the basis of an increase in the amount of heat generation of the driver circuit unit 40A caused by an increase in the motor supply power when transitioning from the first period to the second period. Therefore, even when transitioning from the first period to the second period in the limit drive control by the predetermined drive pattern, the temperature of the driver circuit unit 40A can be prevented from exceeding the allowable upper limit temperature. In this way, when the electric compressor 10 starts, the driver circuit unit 40A can be more surely maintained at the allowable upper limit temperature or lower.

In an example illustrated in FIG. 8, the first predetermined rotational speed of the first period and the second predetermined rotational speed of the second period are set as respective fixed values, and the rotational speed increases in a stepwise fashion, but not limited to this configuration. For example, as in a modification illustrated in FIG. 9, the second predetermined rotational speed may smoothly increase so as to draw an S-shaped curve on a graph. According to this modification, as illustrated in FIG. 9, the temperature rise of the heat generation component when transitioning from the first period to the second period in the power limit control, or the temperature rise of the heat generation component when transitioning from the power limit control to the normal control can be suppressed.

In this embodiment, the power limit control is divided into the two periods, but may be divided into three or more periods. In the example illustrated in FIG. 9, the second period can be configured by multiple periods for increasing the rotational speed in a stepwise fashion for each control period.

OTHER EMBODIMENTS

The preferred embodiments have been described above, but the present application is not limited to the above-mentioned embodiments at all and can be variously modified without departing from the spirit of the present application.

In the respective embodiments described above, the driver circuit unit 40A is mounted on the mounting surface 1*c* of the housing 1 within which the intake refrigerant flows in the outer surface of the housing 1. However, the present application is not limited to this example. The driver circuit unit 40A may be mounted at a position to be cooled by the intake refrigerant. For example, the driver circuit unit 40A may be mounted on a place of the outer surface of the part (so-called compression mechanism housing) of the housing 1 accommodating the compression mechanism 11 in which the intake refrigerant flows. For example, the driver circuit unit 40A may be mounted on the inner surface of the housing 1, and in direct or indirect contact with the intake refrigerant. For example, the driver circuit unit 40A may be separated from the synchronous motor 12, and the driver circuit unit 40A may be disposed in contact with a piping member in which the intake refrigerant flows from the evaporator toward the compression mechanism 11.

In the above respective embodiments, the temperature detection unit is the thermistor 41, but is not limited to this example. The temperature detected by the temperature detection unit is the temperature of the heat generation component of the driver circuit unit 40A, but is not limited to this configuration. For example, the detected temperature may be a circuit board temperature of the driver circuit unit 40A. The relevant temperature to the temperature of the driver circuit unit 40A may be, for example, an ambient temperature of the driver circuit unit 40A. The relevant temperature is not a temperature of a space in which the driver circuit unit 40A is housed, but may be an external temperature of the housing 1.

In the respective embodiments described above, the electric compressor 10 is intended for the refrigeration cycle of the vehicle air conditioning apparatus. However, the present disclosure is not limited to this example. For example, the electric compressor 10 may be intended for a refrigeration cycle of a freezer-refrigerator mounted on a vehicle, or intended for a refrigeration cycle mounted on a container. Also, the electric compressor 10 may be intended for not a movable refrigeration cycle but a stationary refrigeration cycle.

The invention claimed is:

1. A motor-driven compressor system comprising:

a compressor that draws and compresses refrigerant of a refrigeration cycle;

an electric motor that drives a compression mechanism;

a driver circuit disposed at a position to be cooled by refrigerant drawn by the compressor, the driver circuit supplying a power to the motor for driving the motor;

a temperature sensor that detects a temperature related to the driver circuit; and a motor controller disposed in the driver circuit to control a drive state of the motor based on a drive state command of the motor output from a refrigeration cycle controller that controls the refrigeration cycle, wherein the motor controller stores a predetermined drive pattern corresponding to a temperature characteristic of the driver circuit after starting the motor, when the temperature detected by the temperature sensor at a time of starting the motor is higher than or equal to a predetermined temperature, the motor controller performs a limit drive control according to the predetermined drive pattern regardless of the drive state command, and after the limit drive control is finished, the motor controller transitions to a normal drive control for driving the motor based on the drive state command, the predetermined drive pattern is set, when initially starting the motor, based on a heat generation characteristic of the driver circuit unit and a cooling characteristic of the driver circuit unit caused by the refrigerant, when starting the motor, the predetermined drive pattern is set to enable the limit drive control in which a motor control device drives the motor by limiting a supply power to the motor not to allow the temperature of the driver circuit unit to exceed an allowable upper limit temperature, the predetermined drive pattern has a first period and a second period transitioned from the first period, and a second supply power in the second period is larger than a first supply power in the first period.

2. The motor-driven compressor system according to claim 1, wherein the predetermined drive pattern is set based on an increase in heat generation amount of the driver circuit caused by an increase in the supply power when transitioning from the limit drive control to the normal drive control such that the temperature of the driver circuit does not exceed the allowable upper limit temperature.

3. The motor-driven compressor system according to claim 2, wherein the predetermined drive pattern has a first period and a second period transitioned from the first period, the supply power in the second period being larger than the supply power in the first period, and the predetermined drive pattern is set based on an increase in heat generation amount of the driver circuit caused by an increase in the supply power when transitioning from the first period to the second period such that the temperature of the driver circuit does not exceed the allowable upper limit temperature.

4. The motor-driven compressor system according to claim 1 that is mounted in a vehicle.

5. The motor-driven compressor system according to claim 1, wherein the temperature related to the driver circuit is a temperature of the driver circuit.

6. The motor-driven compressor system according to claim 1, wherein the temperature related to the driver circuit is a circuit board temperature of the driver circuit.

7. The motor-driven compressor system according to claim 1, wherein the temperature related to the driver circuit is an ambient temperature of the driver circuit.

8. The motor-driven compressor system according to claim 1, wherein the temperature related to the driver circuit is an external temperature of a housing containing the driver circuit.

9. The motor-driven compressor system according to claim 1, wherein the temperature related to the driver circuit is the temperature of a heat generation component of the driver circuit.

10. The motor-driven compressor system according to claim 1, wherein the drive state command is a rotational speed command to the motor.

11. The motor-driven compressor system according to claim 1, wherein the predetermined drive pattern is set on the basis of the temperature characteristic of the driver circuit.

12. The motor-driven compressor system according to claim 11, wherein the predetermined drive pattern is set on the basis of, the heat generation characteristic and a cooled characteristic of the driver circuit, and the cooling characteristic of the driver circuit caused by intake refrigerant.

13. The motor-driven compressor system according to claim 1, wherein the predetermined drive pattern is set from multiple measurement results with an estimated interpolation.

14. The motor-driven compressor system according to claim 1, wherein the predetermined drive pattern is set based, in part, on the starting range of the electric compressor.

15. The motor-driven compressor system according to claim 1, wherein the predetermined drive pattern is set based on a variation in the heat generation characteristic of a heat generation component.

16. The motor-driven compressor system according to claim 1, wherein the limit drive control is a rotational speed limit drive control.

17. A motor-driven compressor system comprising:

a compressor that draws and compresses refrigerant of a refrigeration cycle;

an electric motor that drives the compressor;

a driver circuit disposed at a position to be cooled by refrigerant drawn by the compressor, the driver circuit supplying a power to the motor for driving the motor;

a temperature sensor that detects a temperature related to the driver circuit; and a motor controller disposed in the driver circuit to control a drive state of the motor based on a drive state command of the motor output from a refrigeration cycle controller that controls the refrigeration cycle, wherein the motor controller stores a predetermined drive pattern corresponding to a temperature characteristic of the driver circuit after starting the motor, when the temperature detected by the temperature sensor at a time of starting the motor is higher than or equal to a predetermined temperature, the motor controller performs a limit drive control according to the predetermined drive pattern regardless of the drive state command, and after the limit drive control is finished, the motor controller transitions to a normal drive control for driving the motor based on the drive state command, the predetermined drive pattern is set, when initially starting the motor, based on a heat generation temperature of the driver circuit unit and a cooling temperature of the driver circuit unit caused by the refrigerant, when starting the motor, the predetermined drive pattern is set to enable the limit drive control in which a motor control device drives the motor by limiting a supply power to the motor not to allow the temperature of the driver circuit unit to exceed an allowable upper limit temperature, the predetermined drive pattern has a first period and a second period transitioned from the first period, and a second supply power in the second period is larger than a first supply power in the first period.

18. The motor-driven compressor system according to claim 1, wherein the motor controller finishes the first period when a first predetermined time period elapses, and the motor controller finishes the second period when a second predetermined time period elapses.

19. The motor-driven compressor system according to claim 1, wherein the motor controller performs the limit drive control without repetitively acquiring the temperature from the temperature sensor.

* * * * *